US005173067A

United States Patent [19]

Biba

[11] Patent Number: 5,173,067

[45] Date of Patent: Dec. 22, 1992

[54] SCUBA TAKE-UP REEL

[75] Inventor: Scott I. Biba, Mazomanie, Wis.

[73] Assignee: Pegasus Products, Inc., Waukesha, Wis.

[21] Appl. No.: 833,983

[22] Filed: Feb. 11, 1992

[51] Int. Cl.[5] ..... B63C 7/02

[52] U.S. Cl. ..... 441/26; 242/107.3; 242/156; 242/96

[58] Field of Search ..... 441/6, 23-26; 242/54, 85, 96, 107.3, 156

[56] References Cited

U.S. PATENT DOCUMENTS

| | | | |
|---|---|---|---|
| 2,673,694 | 3/1954 | Howell | 242/107.3 |
| 3,423,044 | 1/1969 | Beiderwell | 242/96 |
| 3,593,940 | 7/1971 | Stanton | 242/96 |
| 3,705,697 | 12/1972 | Chagnon | 242/85 |
| 3,940,814 | 3/1976 | Bayles et al. | 441/26 |
| 4,748,937 | 6/1988 | Musetti | 119/109 |
| 4,756,486 | 7/1988 | Campbell | 242/156 |
| 4,778,422 | 10/1988 | Saulnier et al. | 441/26 |
| 4,854,522 | 8/1989 | Brown et al. | 242/107.7 |

OTHER PUBLICATIONS

"Neg'ator® constant-force spring motors" leaflet, 2-sided, pp. 6, 9.

"Spring-Power Packages" leaflet, 2-sided; Ametek Hunter Spring Products, Sellersville, Pa.; 1987.

*Primary Examiner*—Jesus D. Sotelo

*Attorney, Agent, or Firm*—Lathrop & Clark

[57] ABSTRACT

A plastic spool is rotatably mounted between the two plastic halves of a housing. A spring motor is mounted to the housing and engages with a gear train connected to the housing such that a spring will suffice to retract a length of line ten times as long connected to the spool and windable thereon. The housing has an opening which allows the entrance of water. The line is connected to a floating surface bouy and is automatically extended as a scuba diver descends to lower aquatic depths. Vanes extend radially from the spool and cooperate with the water to resist too rapid rewinding of the line onto the spool as a diver ascends. The housing has a hook-shaped handle for restraining of the reel and also has a clip which retains a writing instrument which may be used for underwater communication between divers by writing on a planar surface of the housing.

8 Claims, 3 Drawing Sheets

SCUBA TAKE-UP REEL

FIELD OF THE INVENTION

This invention relates to take-up reels in general, and to take-up reels designed for use by scuba divers in an underwater environment in particular.

BACKGROUND OF THE INVENTION

Scuba diving (i.e. diving employing Self-Contained Underwater Breathing Apparatus) is a sport of ever increasing popularity. The continual improvement in the equipment employed by sports divers and the resulting improved safety has played an important role in the growth in popularity.

One vital dive safety practice has always been the use of diving lines. Perhaps the most frequent use of diving line is its employment with a dive buoy or marker. Divers have long been required when diving in public waterways and lakes where boat traffic may be present to fly the international diver flag (red field with white diagonal stripe) on the surface of the water above where the scuba divers are diving. The purpose of the diving flag is to warn water craft away from the area where the flag is flying so that divers are not injured when they come to the surface. The importance of the diving flag is understood when it is realized that a scuba diver, although he can hear a motorboat in his vicinity, is unable to tell the direction from which the powerboat is coming because of the high velocity of sound in water. The result is that a scuba diver, who for any number of reasons as for example a low air supply, must return to the surface, is inherently unable to detect an approaching motorboat.

Because scuba divers will often range hundreds of yards to a mile or more in the course of an underwater expedition, it is important that the dive flag attached to a surface buoy is brought along with them. It is in this instance that the sports scuba diver will most often employ a line connecting the diver and the surface buoy with the attached diving flag so that the buoy may follow the diver as he pursues his underwater path. However, a problem arises in connection with the dive marker buoy and the line attaching it to the diver. As the diver traverses his underwater path, his depth will frequently change to match that of the bottom topography. The result will be that he must constantly let out line and wind in line in order to keep the position of the dive marker buoy from drifting away from the spot on the surface directly above his underwater position, because when the diver ascends he creates slack in the line connecting him to the dive buoy.

In addition to the basic problem associated with a dive marker buoy, ice diving, cave diving, and wreck diving are situations in which a diver will normally employ a safety line.

Ice diving is a pastime of scuba divers in northern climates involves the diving in ice-covered northern lakes which are entered from the surface by a hole in the ice. Here a safety line is essential to assure the diver can find his entry hole through the ice which represents his only means for leaving the water when his air supply runs low.

Similarly in cave and wreck diving, the diver's only assured route to the surface is back along the route he has already traversed, and a safety line is essential to assure the diver does not become lost in retracing his path to the surface.

In all the foregoing situations, it is important that the line be taut and that excess slack line not be allowed to accumulate where it may tangle with the diver or obstructions on the bottom and imperil the safety of the diver.

Known reels for use with safety lines and the like employ hand cranks which require two-handed operation by the diver. Other types of reels employ electrical motors and are unsuitable for use underwater. Yet other reels employ coil springs to retract line and are therefore unsuitable for use with diving lines which of necessity must be of considerable length.

Hand-wound scuba diving take-up reels monopolize the use of both of the diver's hands and require considerable effort on the part of the diver both in winding the string and in rewinding it.

Another problem not dealt with by prior reels is the necessity of a scuba diver to combine as many different safety features as possible in each piece of dive equipment.

What is needed is a scuba diving take-up reel suitable for one handed operation with automatic take-up of safety line combining the functions of a writing slate and a maximum rate of ascent indicator.

SUMMARY OF THE INVENTION

The scuba take-up reel of this invention has a line take-up spool which is rotatably mounted within two halves of a take-up reel housing. The take-up has a spring motor mounted on one-half of the take-up reel housing and connected to the spool by a gear train. The ratio of the gear train is such that approximately 10 feet of line are wound on the spool for each foot of the spring employed by the spring motor. The take-up spool has two flanges between which the line is wound. One of the flanges is toothed and interfaces with a spring-biased catch that responds to a hand operated button mounted on the handle of the take-up reel. Actuation of the button on the handle allows the line to freely wind up if it is slack and to pay out in response to line tension.

The spool has a cylindrical surface disposed between the spool flanges for the reception of the diving line. The spool has a central web connecting the take-up surface to a central pivot which is in turn journaled to opposed pivot stems formed from the two sides of the case. A hydraulic governor or speed control device may be constructed by disposing radial vanes between the line take-up surface and the axial journal of the spool on the side of the spool opposite the gear train connected to the spring motor. These vanes serve to retard to the maximum rate at which line is withdrawn into the reel. For instance, the maximum rate of line retrieval might be limited to 30 feet per second to indicate a maximum desirable rate of ascent to the surface by a diver.

At least one side of the casing will have an outwardly disposed surface suitable for writing on with a pencil, grease pen or the like. Furthermore, the diving reel will mount a clip or snap for retaining a writing instrument.

It is an object of the present invention to provide a diving reel which is self-winding.

It is another object of the present invention to provide a diving reel which is adapted for one handed control for allowing line to be paid out or retracted.

It is an additional object of the present invention to provide a diving reel which employs a governor to prevent the line from being wound onto the reel too rapidly.

It is also an object of the present invention to provide a diving reel which provides means for two way written communication between divers.

It is a still further object of the present invention to provide a diving reel which employs mechanical advantage to allow a spring of a given length to rewind a line of much greater length.

It is yet another object of the present invention to provide a scuba take-up reel which provides constant tension on the line as it is paid out or wound up.

Further objects, features, and advantages of the invention will be apparent from the following detained description when taken into conjunction with the accompanying drawings.

DESCRIPTION OF THE PREFERRED EMBODIMENT

Figure 1:
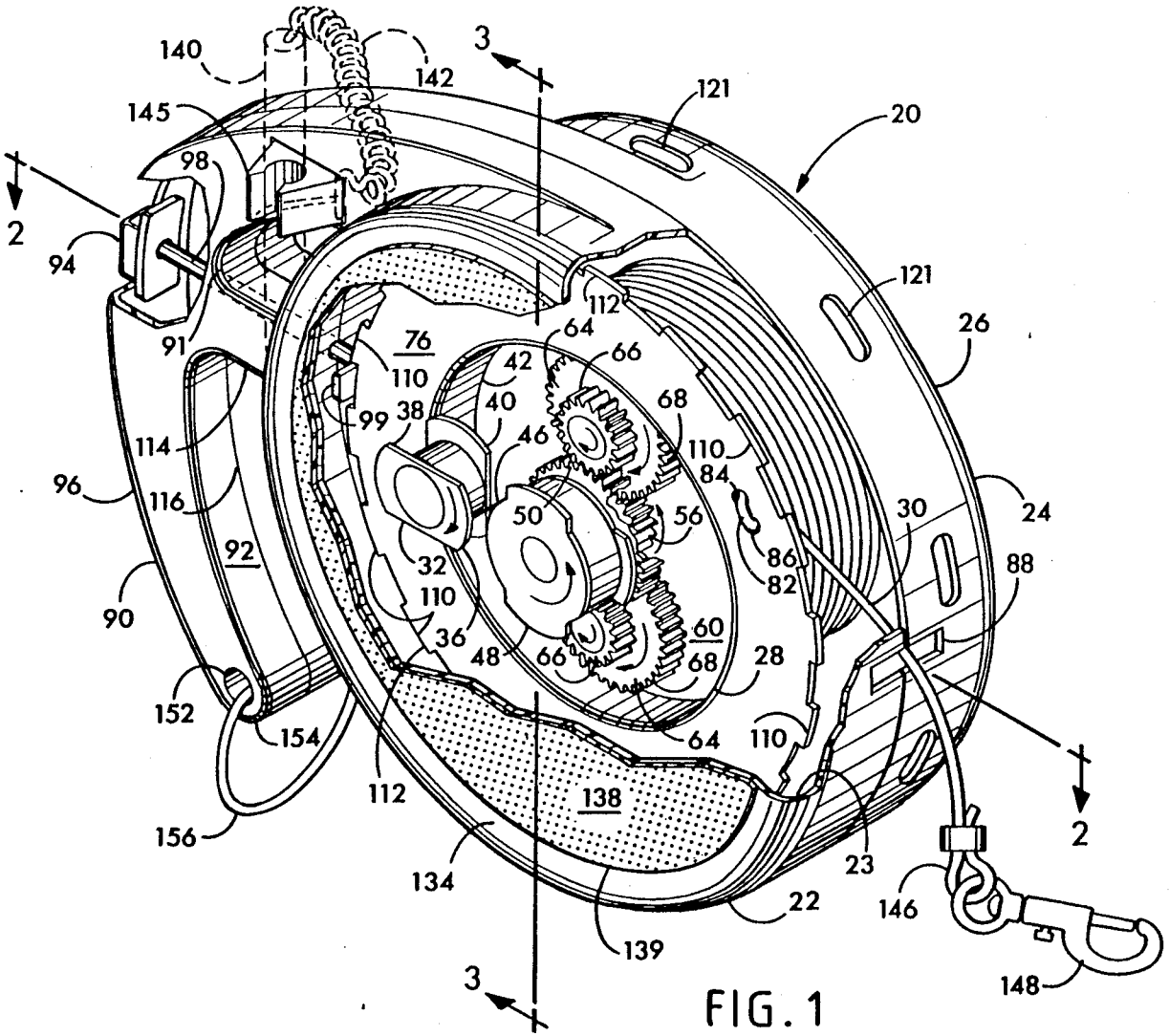
FIG. 1 is an isometric view partly cut away of the scuba take-up reel assembly of this invention having a length of safety line wound thereon.
Figure 2:
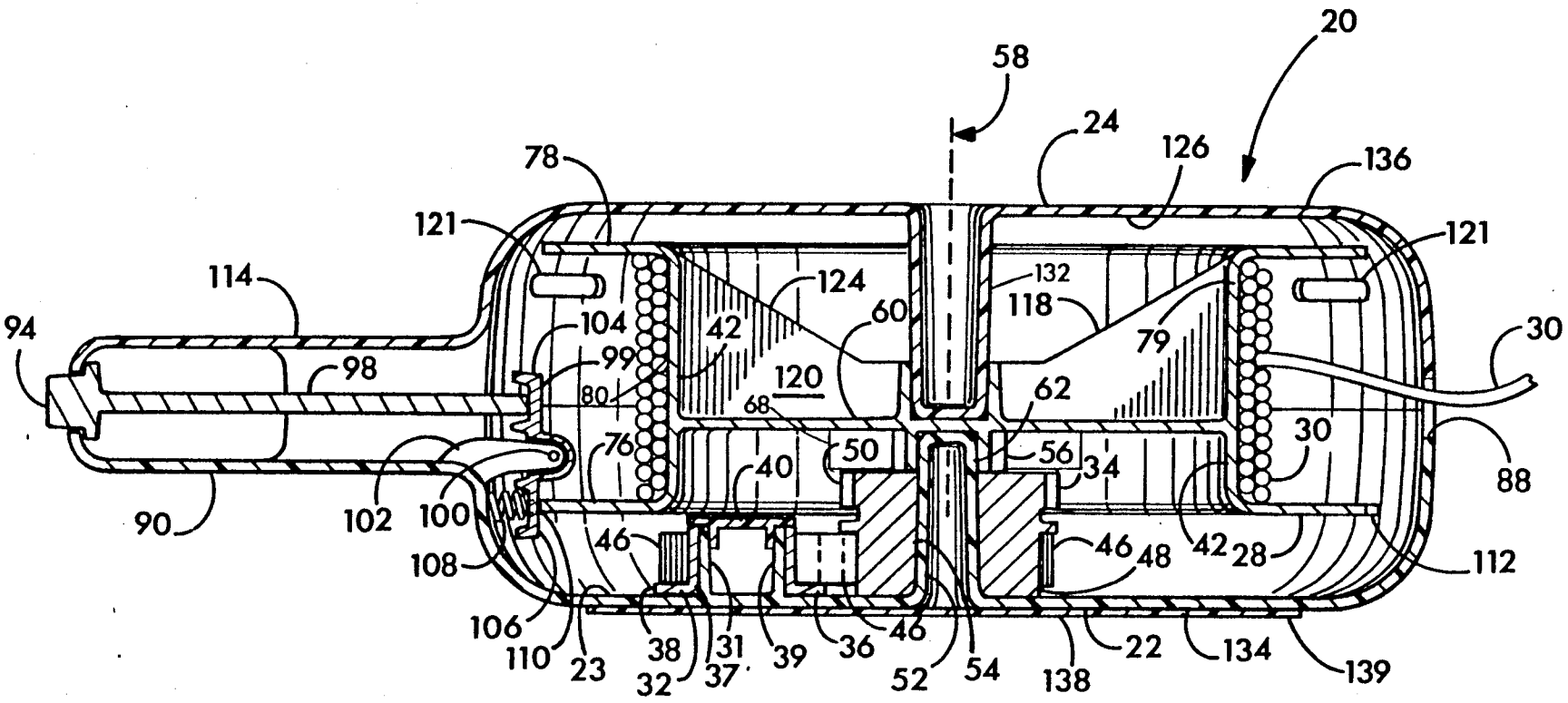
FIG. 2 is a cross sectional view of the scuba take-up reel of FIG. 1 taken along section 2—2.
Figure 3:
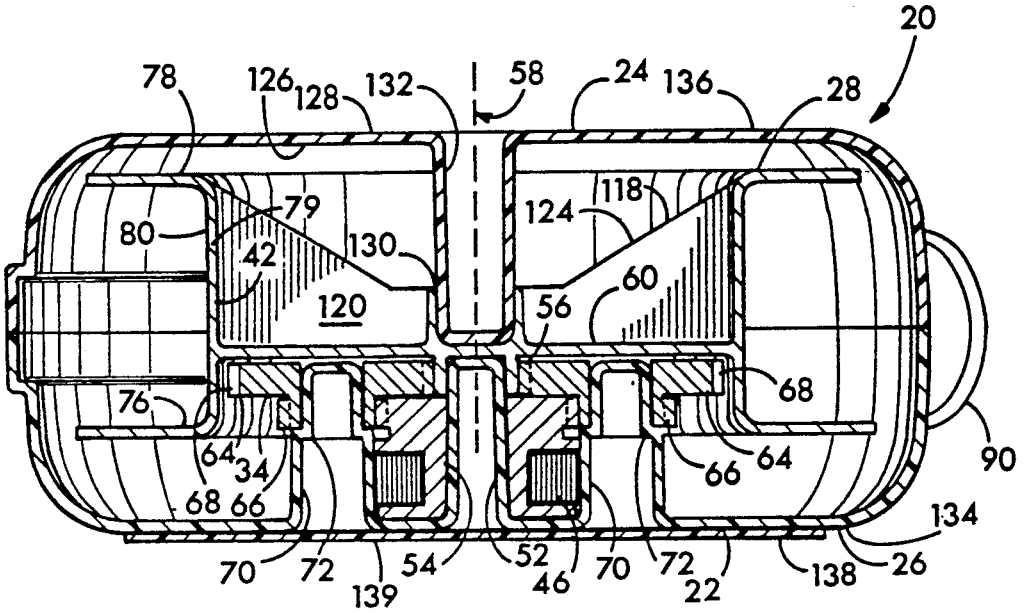
FIG. 3 is a cross sectional view of the take-up reel of FIG. 1 taken along section line 3—3 with the safety line removed for clarity.
Figure 4:
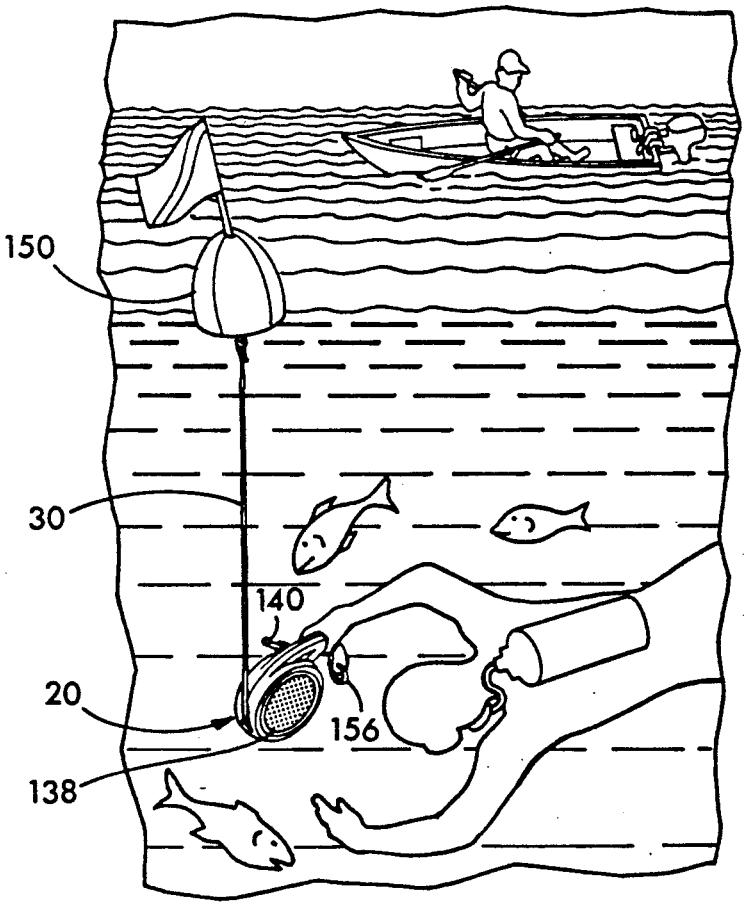
FIG. 4 is a pictorial view of a scuba diver employing the take-up reel of FIG. 1.

Referring more particularly to FIGS. 1–4 wherein like numbers refer to similar parts, a scuba take-up reel assembly 20 is best shown in FIG. 1. The take-up reel 20 is comprised of an upper housing half 22 and a lower housing half 24 which together form the housing 26 as shown in FIGS. 2, 3, and 4. The housing 26 is formed of plastic, for example ABS plastic. Mounted between the upper housing 22 and the lower housing 24 is a take-up spool 28 upon which a quantity of cord or safety line 30 is wound. The spool 28 is biased in a rewound position by a spring motor 32 which is mounted between the upper housing 22 and the spool 28. An exemplary spring motor is the NEG'ATOR* spring motor, part number 20006, supplied by Hunter Spring Products, 900 Clymen Avenue, Sellersville, Pa. 18960. The spring motor 32 applies a constant torque or rewind force to the spool 28 through a gear train 34. The spring motor 32 delivers constant torque, and works on the principle that the wound spring 46, when released recurls to a preset curvature.

The spring motor 32 consists of a first spool 36 which is rotatably mounted to the housing 26 and a second spool 48 which engages with and rotates coaxially with the take-up spool 28. The first spool 36 has an upper flange 38 which is connected to a cylindrical section 42 of relatively small diameter. The cylindrical section 42 is journaled to a spring motor stem 39 which extends from the upper housing half 22 and about which the spring motor spool 36 rotates. Wound about the spool 36 is the spring motor spring 46 which consists of approximately eight feet of spring material preferably of a corrosion-resistant alloy which in its relaxed state forms a coil with small inner diameter around the first spring spool 36.

As the cord 30 is withdrawn from the take-up reel 20, the gear train 34 causes the spring 46 of the spring motor 32 to be wound around the second spring motor spool 48. The spring 46 is wound in a direction opposite to its relaxed state. The spring 46, in returning to its relaxed state, drives the second spring spool 48 which drives gear assembly 64 and hence the take-up spool 28 with respect to the first spring spool 36 at a constant torque. The spring motor 32 provides several advantages to the take-up reel 20. First, it provides constant torque which results in a constant tension on the safety line 30. This provides an advantage over an ordinary coil spring as a source of rewinding force in that it does not become more and more difficult to extract line 30 from the reel as more and more line is paid out. Secondly, there is no tendency for the rewind force to become inadequate before all the line is wound on the reel. The spring motor 32 also provides a winding torque over a relatively large number of rotations of the second spring motor spool 48 which allows the reel to retract a relatively large amount of line without prohibitively large gear ratios in the gear train 34.

The gear train 34 allows the use of an eight-foot spring 46 to retract over 80 feet of line 30. The gear train 34, shown in FIGS. 1, 2, and 3, employs a first gear 50 which is rigidly mounted to the second spring motor spool 48 and rotates with the second spring motor spool 48 about a common axis 58. A stem 52 extends inwardly from the upper housing half 22. The second spring motor spool 48 and the first gear 50 are mounted on the stem 52 as a single unit with the stem 52 journaled within the bore 54 of the second spring motor spool 48 and first gear 50.

The first gear 50 and spool 48 combination may be made of teflon or any plastic which differs from the plastic of the housing stem 52 to provide a simple but low friction bearing between the gear 50 and the stem 52.

The take-up spool 28 is driven by a small last gear 56 which extends rigidly from the central web 60 of the spool 28. The last gear 56 has an inner journal bearing 62 which rotatably engages with the stem 52 such that the last gear 56, the first gear 50, and the spring motor take-up spool 48 all are mounted on the stem 52 and rotate about a common axis 58. The journal 62 formed within the last gear 56 is made of a plastic such as nylon which will form a low friction bearing with the ABS stem 52. The last gear 56 is driven by the first gear 50 through two outer gear assemblies 64. The outer gear assemblies 64 are composed of an upper gear 66 rigidly and coaxially connected to a lower gear 68. Both upper gears 66 engage in driven relation with the first gear 56. The lower gears 68 engage in driving relation with the last gear 56. Although a single outer gear assembly 64 is all that is required to connect the spring motor 32 with the spool 28, the use of two outer gears 64 results in smoother, more balanced operation of the gear train 34. The gear train 34 is a reverted gear train (i.e. one in which the first and last gears 50, 56 are on the same axis 58).

The ratios of teeth between the first and last gears and the outer gear assemblies of the gear train 34 in the preferred embodiment are selected such that a spring motor 32 with a spring 46 with an 8-foot length will cause approximately 85 feet of line 30 to be wound on the take-up spool 28.

As best shown in FIG. 3, the outer gear assemblies 64 are mounted on outer gear stems 70 which extend inwardly from the upper housing half 22. The outer gear stems 70 have a step 72 which retains the outer gears 64 in the proper relationship relative to the first gear 50 and the last gear 56. The outer gear assemblies 64 are made of nylon, teflon or other plastic with sufficient lubricity so as to freely rotate on the outer stems 70.

The first spring motor spool 36 has an inner journal bearing surface 37 and is mounted on a spring motor stem 39 which extends inwardly from the inner side 23 of the upper housing half 22. The first spool 36 is retained on the spring motor stem 39 by a flanged retaining cap 40 which engages the inside surface 31 of the spring motor stem 39. The first spring motor spool is made of a plastic which in combination with the stem 39 has high lubricity.

As best shown in FIGS. 2 and 3, the take-up spool 28 has an upper flange 76 and a lower flange 78 which are connected by a cylindrical winding surface 80. The safety line 30 has a first end 82 which is connected to the spool 28 by passing the first end 82 of the line 30 through the attachment apparatuses 84, 86 and the upper flange 76. The safety line 30 is then wound onto the winding surface 80 disposed between the upper flange 76 and the lower flange 78.

The line 30 enters the housing through a cord outlet opening 88 formed in the upper 22 and lower 24 housings opposite the hook-shaped handle 90 best shown in FIG. 1. The positioning of the hook-shaped handle 90 opposite the cord outlet 88 has the advantageous result that when the take-up reel 20 is hooked by means of the handle 90 about a stationary object, the inner convex surface 92 of the handle 90 retains the reel 20 and resists the tension produced by the line 30. This feature of the take-up reel 20 can be used advantageously by a scuba diver when he wishes to momentarily attach the reel to an underwater object while performing investigations in the vicinity of such anchoring object. He may thus avoid the hazard that the safety line will become entangled while he is so engaged.

Portions of the upper and lower housings 22, 24 define a grab hole 91 in the handle above the actuation rod 98. The grab hole 91 permits the handle 90 to be grasped alternately from above or below to facilitate easy gripping of the reel or transfer of the reel 20 from hand to hand.

The handle 90 incorporates a button 94 located on the outer surface 96 of the handle 90 opposite the concave surface 92. As shown in FIG. 2, the button is connected to an actuation rod 98 which engages one side of a pawl 99 which is pivotally mounted to the housing 26 by a pivot pin 100 which is mounted on a pivot pin bracket 102. One side of the pawl 104 is engaged by the actuation rod 98 and the other side 106 of the pawl 99 is biased away from the housing 26 by a spring 108. The spring causes one side 106 of the pawl 99 to engage teeth 110 on the upper flange 38 of the reel 28.

The upper flange 38 teeth 110 are formed along the outer peripheral edge 112 of the upper flange 38 and are best shown in FIG. 1. When the button 94 is depressed by the diver's hand which holds the handle 90, the actuation rod 98 causes the pawl 99 to pivot about the pivot pin 100 and compress the pawl spring 108 which moves the spring side 106 of the pawl 99 out of engaging relationship with the teeth 110.

The take-up spool 28 may then rotate, either taking up line 30—if there is no tension on the line—or paying line out if the line 30 is taut. The actuation rod 98 communicates with the pawl 99 through a passageway 114 formed in the upper housing 22 and lower housing 24. The passageway 114 serves not only to house the extension rod 98 but to reinforce the handle 90 and to position the diver's hand adjacent to the button 94 by means of the outer surface 116 formed by the passageway 114.

In scuba diving, water pressure and also the pressure of the air supplied to the diver by the scuba equipment changes rapidly with depth. Ascending 16½ feet through the water results in a decrease in pressure equivalent to ascending from sea level to a mountaintop at 17,000 feet. To safely transit these extremes in pressure, it is imperative that the diver control his rate of ascent. Too rapid ascent can cause injury or even death. Therefore, it is imperative that the diver be able to monitor his rate of ascent. The diving reel 20 by incorporating a hydraulic governor 118 can advantageously perform the function of warning the diver when he is ascending too rapidly. The hydraulic governor 118 is shown to be formed on the take-up spool 28 by vanes 120 which are disposed between the cylindrical shell 79 which forms the winding surface 80 and the central web 60 opposite the gear train 34. The vanes 120 form a rudimentary impeller 124 or pump on the rear face of the web 60. A number of circumferentially extending slots 121 are located along the periphery of the housing to allow the smooth exchange of water between the interior and the exterior of the reel.

Because the power required to drive a pump increases rapidly with increased pump speed, the impeller 124 formed by the vanes 120 may be designed to equal the power supplied by the drive means such as the spring motor 32 when the take-up reel 28 rotates at a speed corresponding to the desired maximum line retraction speed. Alternatively, the impeller 124 shown in FIGS. 2 and 3 could be designed with increased efficiency by allowing water to flow in and out of the case along a baffle disposed on the inside 126 of the lower housing such that water would be drawn in along the axis 58 of the spool 28, accelerated by the vanes 120, and expelled from the case adjacent to the cylindrical shell 79. Such an alternative more efficient pump could prevent even a take-up reel powered by a hand crank from rewinding line faster than the desirable ascent rate of 30 to 60 feet per minute.

A journal bearing 130 extends from the take-up spool web 60 and engages rotatably with lower housing stem 132 which extends from the lower housing surface 128 opposite the upper housing stem 52. The journal surface 130 and the lower housing stem 132 are formed of different plastics resulting in a low friction bearing.

Because sound travels poorly underwater, communication between divers is normally accomplished by writing on an erasable slate or with the use of hand signals. Normally, hand signals are sufficient and in reliance upon this divers frequently neglect to carry the means for written communication. However, situations arise where hand signals prove inadequate and then the lack of a writing slate is sorely felt.

The dive take-up reel 20 can easily accommodate on one of its exterior surfaces 136, preferably the upper surface 134, a writing surface 138 which is adapted to receive markings from a grease pencil 140, underwater pen, lead pencil or the like. The writing surface 138 may be formed as an integral part of the housing, but is preferably formed of light colored acrylic or ABS plastic plate 139 and affixed to one or both sides of the housing for convenient access by a diver. The grease pencil 140 will normally be attached by a short cord 142 to the dive reel 20 and will conveniently be retained in a retention clip 145 when not in use, as shown in FIG. 1 (for clarity the grease pencil and cord have been shown in phantom lines).

The line 30 wound on the take-up spool 28 has a second end 146, shown in FIG. 1, which is attached to a swivel-snap hook 148. The swivel-snap hook 148 prevents the line from becoming twisted as it allows an attached dive float 150, shown in FIG. 4, to turn freely with respect to the line second end 146. The handle 90 has portions forming a hole 152 at the extreme end 154 of the handle. The hole 152 allows a number of take-up reels 20 to be ganged together if a line length of greater than that available on a single spool 20 is required. The swivel hook 148 may be clipped directly to the hole 152 or may be clipped to a small loop of cord 156 which passes through the hole 152 in the handle 90.

The bearing surfaces between the gears, spools, and their mounting stems will preferably provide low friction bearings. The surfaces may be made to provide low friction bearings by employing different plastics for the construction of the gears, stems and spool bearing surfaces. The bearing surfaces may also be coated with thin coatings of low friction materials. Furthermore, bearings could be used of the plastic or bronze bushing type which fit between the bearing surfaces of the gears and their stems and the spools and their stems.

Where the pawl 99 engages the outer edge 112 of the spool 28 the spool 28 may have teeth 110 or the pawl 99 may frictionally engage the outer edge 112 to retard the motion of the spool 28.

It should be understood that although a reverted gear train 34 is shown other gear trains such as a planetary gear could be employed to link the spring motor 32 to the take up spool 28.

It should further be understood that where a hand operated button is shown to control the winding and unwinding of safety line 30 a ratchet and pawl arrangement similar to that employed by window shades which allows the retraction and rewinding of the cord without the use of a button could be employed.

It is understood that the invention is not confined to the particular construction and arrangement of parts herein illustrated and described, but embraces such modified forms thereof as come within the scope of the following claims.

I claim:

1. A handheld portable reel for scuba diving comprising:

a) a housing having portions a defining an opening for the entrance of water;

b) a take-up spool rotatably mounted to the housing and adapted to be used with a length of line wound about the spool, the spool defining an axis of rotation;

c) a spring motor having a first spool rotatably mounted to the housing and a second rotatable spool;

d) a first gear fixed to the second spool and rotatable with the second spool; and e) a second gear fixed to the take-up spool, and engaged with the first gear as part of a gear train such that a single rotation of the spring motor second spool results in greater than one revolution of the take-up spool, wherein the gear train further comprises two outer gear assemblies rotatably mounted to the housing, each assembly having an upper gear and a lower gear which are fixed together about a common axis, the lower gears of the two outer gear assemblies being in driving relation with the first gear, and the upper gears being in driven relation with the second gear.

2. A handheld portable reel for scuba diving comprising:

a) a housing having portions defining an opening for the entrance of water;

b) a take-up spool rotatably mounted to the housing and adapted to be used with a length of line wound about the spool, the spool defining an axis of rotation, wherein the take-up spool has at least one peripheral flange having portions defining peripheral teeth, and further comprising a pawl pivotally mounted to the housing and selectably engageable with the teeth to prevent rotation of the take-up spool;

c) a spring motor having a first spool rotatably mounted to the housing and a second rotatable spool;

d) a first gear fixed to the second spool and rotatable with the second spool; and e) a second gear fixed to the take-up spool, and engaged with the first gear as part of a gear train such that a single rotation of the spring motor second spool results in greater than one revolution of the take-up spool.

3. A handheld portable reel for scuba diving comprising:

a) a housing having portions defining an opening for the entrance of water, wherein the housing has upper and lower surfaces between which the take-up spool is rotatably mounted, and wherein at least one of the upper and lower surfaces is adapted to receive markings from a writing instrument;

b) a clip mounted to the housing and adapted for retaining a writing instrument engaged with the housing;

c) a take-up spool rotatably mounted to the housing and adapted to be used with a length of lien wound about the spool, the spool defining an axis of rotation;

d) a spring motor having a first spool rotatably mounted to the housing and a second rotatable spool;

e) a first gear fixed to the second spool and rotatable with the second spool; and f) a second gear fixed to the take-up spool, and engaged with the first gear as part of a gear train such that a single rotation of the spring motor second spool results in greater than one revolution of the take-up spool.

4. A handheld portable reel for scuba diving comprising:

a) a housing having portions defining an entrance for the flow of water therethrough;

b) a spool rotatably mounted on the housing, the spool defining an axis of rotation;

c) a length of line connected to the spool and extending through the entrance;

d) a spring motor connected to a gear train and operably mounted between the housing and the spool so as to rotate the spool with respect to the housing and so adapted to wind an extended length of line onto the spool; and e) a plurality of vanes extending radially from the spool, the vanes having surfaces which are in contact with water when the reel is submerged in water, the vanes serving to restrict the rotation of the spool on the housing by interaction with the water.

5. A handheld portable reel for scuba diving comprising:

a) a housing having portions defining an entrance for the flow of water therethrough;

b) a portion of the housing defining a planar exterior surface adapted to receive markings from a writing instrument;

c) portions of the housing which define a clip which extends outwardly from the reel, the clip being adapted to resiliently engaged a writing instrument with the housing;

d) a writing instrument tethered to the housing and selectably engagable with the outwardly extending housing portions;

e) a spool rotatably mounted on the housing, the spool defining an axis of rotation;

f) a length of line connected to the spool and extending through the entrance; and g) a plurality of vanes extending radially from the spool, the vanes having surfaces which are in contact with water when the reel is submerged in water, the vanes serving to restrict the rotation of the spool on the housing by interaction with the water.

6. A handheld portable reel for scuba diving comprising:

a) a housing having engaged upper and lower halves;

b) a take-up spool rotatably mounted on the housing between the upper and lower halves;

c) a spring motor connected to a gear train and operably mounted between the housing the take-up spool so as to rotate the spool with respect to the housing and so adapted to wind a length of line onto the spool;

d) at least one exterior surface of the housing adapted for receiving marks from a writing instrument;

e) a clip mounted to the housing and adapted for receiving a writing instrument; and f) a length of line connected to the spool and adapted to be wound about the spool, wherein the housing has portions defining a hook shaped handle and the housing has portions forming a line outlet opening opposed to the hook-shaped handle such that when a force is applied to the line, the hooked handle when placed about a retaining anchor will prevent the movement of the reel.

7. A handheld portable reel for scuba diving comprising:

a) a housing having engaged upper and lower halves;

b) a take-up spool rotatably mounted on the housing between the upper and lower halves;

c) a plurality of vanes radially mounted to the spool about an axis of rotation, the plurality of vanes functioning as a hydraulic governor when the reel and the spool within are immersed in water;

d) at least one exterior surface of the housing adapted for receiving marks from a writing instrument;

e) a clip mounted to the housing and adapted for receiving a writing instrument; and f) a length of line connected to the spool and adapted to be wound about the spool, wherein the housing has portions defining a hook shaped handle and the housing has portions forming a line outlet opening opposed to the hook-shaped handle such that when a force is applied to the line, the hooked handle when placed about a retaining anchor will prevent the movement of the reel.

8. A handheld portable reel for underwater scuba diving, comprising:

a) a buoyant float with a safety flag attached thereto;

b) a length of flexible line connected to the float;

c) a rigid housing having portions defining a handle for grasping by one hand of a diver;

d) a spool rotatably mounted to the housing, wherein the flexible line extends from the buoy to the spool and is adapted to be substantially entirely wound onto the spool;

e) a spring motor extending between the housing and the spool, such that the spring motor is extended when the line is unwound from the spool; and f) a mechanical switch located on the housing handle, the switch having portions which engage with the spool, such that depressing the switch allows the rotation of the spool and release of the switch halts the unwinding of the line.

* * * * *